US005319617A

United States Patent [19]

Sonoda

[11] Patent Number: 5,319,617

[45] Date of Patent: Jun. 7, 1994

[54] APPARATUS CASE WITH A ROTATABLE MEMBER

[75] Inventor: Hiroyuki Sonoda, Tokyo, Japan

[73] Assignee: Casio Computer Co., Ltd., Tokyo, Japan

[21] Appl. No.: 892,041

[22] Filed: Jun. 2, 1992

[30] Foreign Application Priority Data

Jun. 7, 1991 [JP] Japan ..... 3-163563

[51] Int. Cl.[5] ..... G04B 37/00

[52] U.S. Cl. ..... 368/294; 368/295

[58] Field of Search ..... 368/294–296, 368/10

[56] References Cited

U.S. PATENT DOCUMENTS

| | | | |
|---|---|---|---|
| 4,420,264 | 12/1983 | Murata | 368/223 |
| 4,479,724 | 10/1984 | Matsumoto et al. | 368/291 |
| 4,815,053 | 3/1989 | Busco | 368/294 |
| 5,122,997 | 6/1992 | Schneider et al. | 368/294 |

*Primary Examiner*—Bernard Roskoski

*Attorney, Agent, or Firm*—Frishauf, Holtz, Goodman & Woodward

[57] ABSTRACT

This invention provides a structure of an apparatus case with a rotation member which can selectively restrict the rotation of a rotation bezel, rotatably mounted on a case body, in one or both of the forward and reverse directions. First and second rotation bezels are rotatably mounted on the case body, and a plate spring for restricting the rotation of the first rotation bezel is provided below the second rotation bezel. The plate spring is partly bent to rise it, thereby forming a hook. A rugged portion is formed on the lower surface of the first rotation bezel and an opening into which the hook is inserted is formed in the second rotation bezel. When the hook does not engage with the rugged portion, the first rotation bezel is freely rotatable. When the hook is inserted into the opening and is engaged with the rugged portion by rotating the second rotation bezel, the first rotation bezel is rotatable only in one of the forward and reverse directions. When the circumferential direction edge of the opening is brought into contact with the lower surface of the hook by rotating the second rotation bezel in the other direction, the hook tightly engages with the rugged portion, thereby preventing the first rotation bezel from rotating in both forward and reverse directions.

5 Claims, 4 Drawing Sheets

APPARATUS CASE WITH A ROTATABLE MEMBER

BACKGROUND OF THE INVENTION

1. Field of the Invention

This invention relates to an apparatus case with a rotatable member, such as a wrist watch case, an electronic timer case, or a compass case.

2. Description of the Related Art

A type of wrist watch has a rotation bezel as a rotation member on its case body to decorate its appearance and to give it a high-graded appearance, as well as to set a timer time or to confirm an elapse of time. The rotation bezel is mounted on the case body to be rotatable in forward and reverse directions. However, a freely rotatable bezel is disadvantageous in that the set time may be changed accidentally. In the conventional wrist watch, to overcome this disadvantage, the rotation bezel has a rugged portion having concavities and convexities on its lower surface and the case body has a plate spring which elastically abuts against the rugged portion. With this structure, the rotation bezel can be rotated in only one direction.

A wrist watch or the like may be more convenient if the rotation bezel is rotatable in forward and reverse directions or in only one direction, in accordance with the user's need and the way of use. For example, if the watch is used as a minutes-timer (e.g., 60-minutes-timer) in which time is measured by the scale of the rotation bezel and the movement of the minute hand, it is desirable that the rotation bezel is rotatable in only one direction during the time measuring operation, since the rotation bezel must not be rotated erroneously and need not be rotated in 60 minutes, once a timer time is set. In contrast, if time count in units of a second on the basis of the scale of the rotational bezel and the movement of the second hand is repeated many times, it is desirable that the rotation bezel be rotatable in both directions, since the scale must be immediately adjusted to the second hand of the watch.

However, in the conventional structure, the bezel is preset to be rotated either one direction or both directions, the user cannot change the preset direction or directions. Even if the rotation bezel rotatable in only one direction is used in the 60-minutes-timer as described above, it is disadvantageous in that it may be erroneously rotated in the preset direction.

SUMMARY OF THE INVENTION

The present invention is derived from the above described situation, and an object thereof is to provide an apparatus case with a rotation member, wherein the direction of rotation of the rotation member can be changed either forward and reverse directions or only one direction.

Another object of the present invention is to provide an apparatus case with a rotation member, wherein unnecessary rotation of the rotation member is prevented.

To achieve the above objects, according to the present invention, there is provided an apparatus case with a rotation member comprising: a case body; a rotation member which is rotatably mounted on the case body and has a rugged portion on at least one part of its surface; a rotation restricting member which engages with the rugged portion of the rotation member to restrict the rotation of the rotation member; and a restriction release member which release the engagement of the rotation restricting member to the rugged portion, thereby rendering the rotation member rotatable.

With the above structure, a simple and convenient apparatus case with a rotation member is obtained, in which the rotation direction of the rotation member is restricted selectively and securely either in one direction or in forward and reverse directions.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
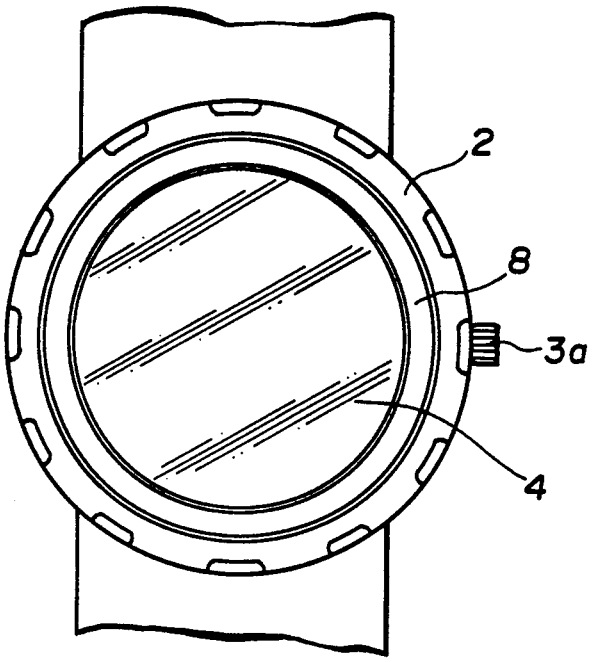
FIG. 1 is a front view of an electronic wrist watch according to an embodiment of the present invention.
Figure 2:
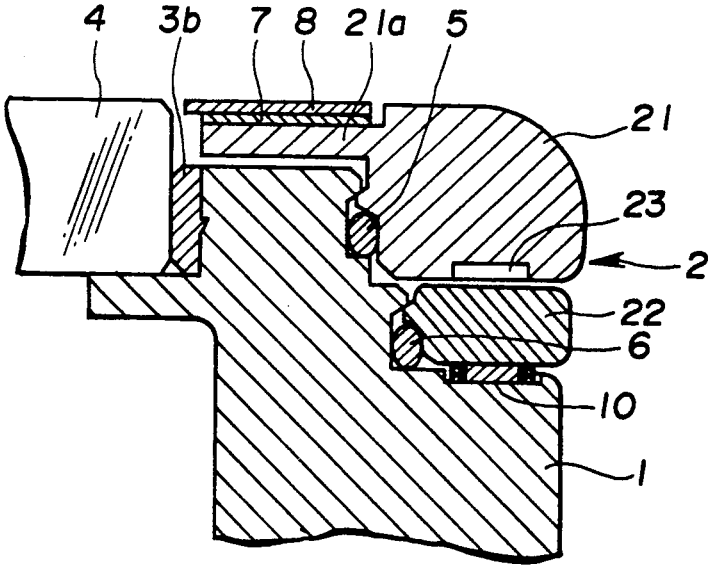
FIG. 2 is an enlarged cross-sectional view showing a part of the electronic wrist watch shown in FIG. 1.

FIG. 1 is a front view of an electronic wrist watch according to an embodiment of the present invention and FIG. 2 is an enlarged cross-sectional view showing a part of the electronic wrist watch shown in FIG. 1. A ring-shaped rotation member 2 is rotatably mounted on the upper portion of a watch case body 1. The rotation member 2 has a ring-shaped indication panel 8 on the inner periphery of the upper surface thereof. A time scale and time numerals are printed on the upper surface of the indication panel 8. A crown 3*a* is an operation knob for operating time indicating hands (not shown) of an analog watch movement held within the watch case body 1. A watch glass 4 is fitted to the upper surface of the watch case body 1 with a packing 3*b* interposed therebetween. The hands of the watch movement (not shown) are visible through the watch glass 4. The rotation member (hereinafter referred to as a rotation bezel) 2 consists of a first rotation bezel 21 and a second rotation bezel 22, which are rotatably attached to the outer periphery of the watch case body 1 with 0 rings 5 and 6 interposed therebetween, respectively. In the present embodiment, the first rotation bezel 21 overlies the second rotation bezel 22. The first rotation bezel 21 performs the same function as a conventional rotation bezel and includes a lip 21*a*, which extends toward the watch glass 4 on the upper surface of the watch case body 1, at its inner peripheral portion. The above-mentioned indication panel 8 is adhered to the upper surface of the lip 21*a* by an adhesive 7 such as adhesive double coated tape. Predetermined scale and numerals to indicate, for example, a timer scale, are printed on the panel 8. The user can set a timer time by rotating the first rotation bezel 21.

Figure 4:
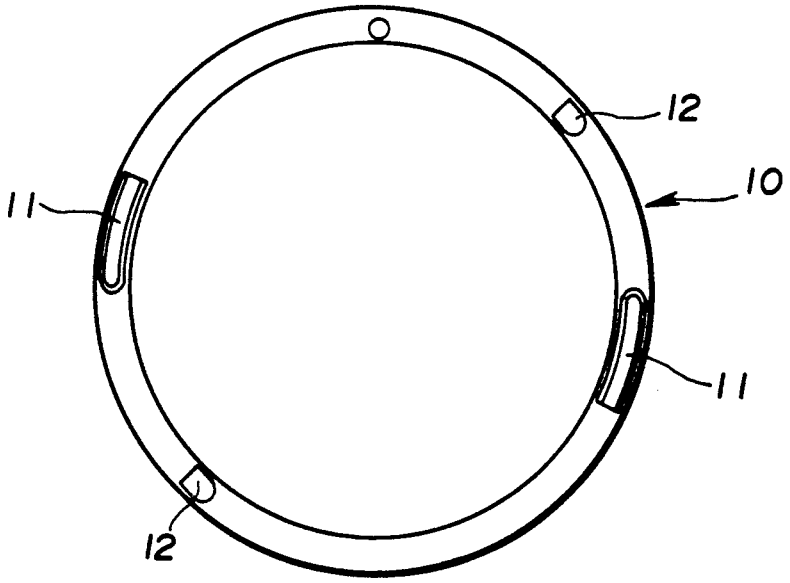
FIG. 4 is a plan view of a plate spring used in the above-mentioned electronic wrist watch.
Figure 5:
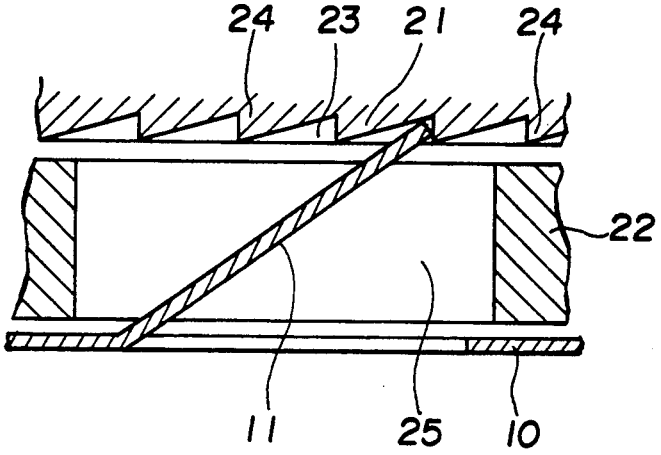
FIG. 5 is an enlarged cross-sectional view, showing a part of the plate spring, for explaining an operation of the plate spring of the electronic watch.
Figure 6:
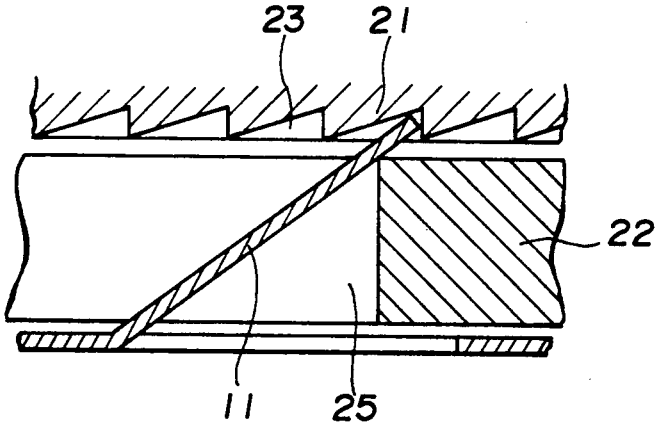
FIG. 6 is an enlarged cross-sectional view, showing the part of the plate spring, for explaining another operation of the plate spring of the electronic watch.

A rugged portion 23 is formed on the whole of the lower surface of the first rotation bezel 21 to restrict the rotation thereof. FIG. 5 shows the rugged portion 23, constituted by saw teeth 24 which are inclined in one direction. When a plate spring 10 engages with the rugged portion 23 of the first bezel 21, the rotation of the bezel 21 is restricted. FIG. 4 is a plan view of the plate spring 10. The plate spring 10 is formed like a ring and has fixing slits 12 at predetermined portions of the plate spring 10. Projections (not shown) of the casing body 1 are inserted into the slits 12, so that the plate spring 10 is fixed to the case body 1. Hooks 11 are formed on the upper surface of the plate spring 10 at two positions oppose each other o the diametrical line of the ring shaped plate spring 10. The hooks 11 are formed by partially cutting the plate spring 10 and benting upward portions defined by the cuts. The hooks can engage with the rugged portion 23 of the first rotation bezel 21. When the hooks 11 engage with the rugged portion 23, the first rotation bezel 21 is rotatable only in one direction in which the inclined surfaces of the saw teeth are leading surfaces, and is prevented from rotating in the other direction in which the vertical surfaces of the saw teeth are leading surfaces. In addition, by changing the relative position of the second rotation bezel 22 with respect to the hooks 11, the rotation of the first rotation bezel 21 in both forward and reverse directions is restricted, as shown in FIG. 6. Thus, in the state of FIG. 5, the hooks 11 of the plate spring 10 function as rotation direction restricting members for the first rotation bezel 21, and in the state of FIG. 6, as rotation restriction members.

Figure 3:
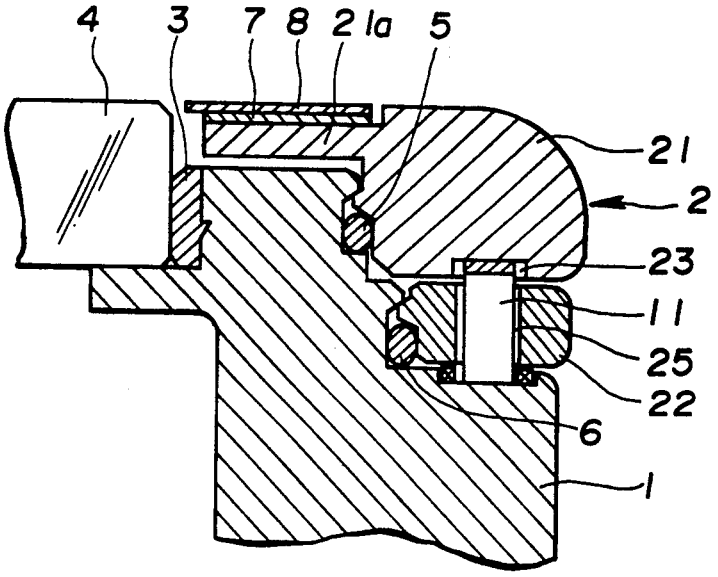
FIG. 3 is an enlarged cross-sectional view showing another part of the electronic watch shown in FIG. 1.

The second rotation bezel 22 is rotated between the spring plate 10 and the first rotation bezel 21. Openings 25, which are slightly longer than the hooks 11, are formed in the second rotation bezel 22 (see FIGS. 3 and 5). When the openings 25 face the hooks 11 of the plate spring 10, the distal end portions of the hooks 11 can engage with the rugged portion 23 of the first rotation bezel 21 through the openings 25. As a result, the first rotation bezel 21 is rotatable only in the above-mentioned one direction. When the second rotation bezel 22 is rotated right-handedly in FIG. 5, the rotation bezel 22 pushes down the hook 11, thereby releasing the engagement of the distal end portion of the hook 11 to the rugged portion 23 of the first rotation bezel 21. Thus, the first rotation bezel 21 becomes rotatable in forward and reverse directions. As described above, the second rotation bezel 22 functions as a release member for releasing the first rotation bezel 21 from the locked state by the hooks 11.

When the second rotation bezel 22 is rotated left-handedly in FIG. 5, the circumferential end edge of the opening 25 contact the lower surface of the hook 11 which is bent upward. In this state, the hook 11 is pressed further upward by the second rotation bezel 22 so as to tightly engage with the rugged portion 23 of the first rotation bezel 21. Thus, the first rotation bezel 21 is in an locked state in which rotation in both forward and reverse rotations is prevented.

In the above-described embodiment of the electronic wrist watch according to the present invention, by operating the rotational position of the second rotation bezel 22, the rotation of the first rotation bezel 21 can be selectively restricted in one direction, and in both directions, and can be allowed in both directions. Therefore, the apparatus case with the rotation member of the invention is convenient to use and prevented the rotation member from rotating erroneously.

Figure 7:
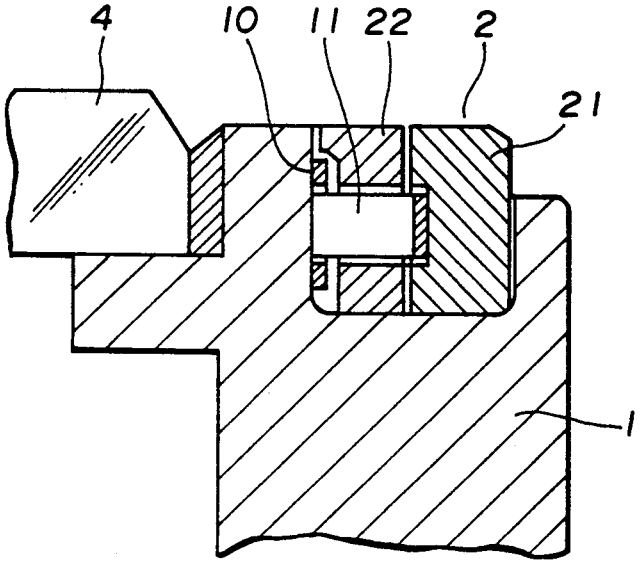
FIG. 7 is an enlarged cross-sectional view showing a part of an electronic watch according to another embodiment of the present invention.

FIG. 7 shows another embodiment of the present invention, wherein the portions corresponding to those of the above embodiment are identified with the same reference numerals as in the above embodiment.

In this embodiment, first and second rotation bezels 21 and 22 constituting a rotation bezel 2 are arranged side by side in a radial direction. More specifically, the first rotation bezel 21 is located on the outer periphery of the second rotation bezel 22 on the upper surface of a watch case body 1. A plate spring 10 for restricting the rotation of the first rotation bezel 21 is attached to the case body 1 inside the second rotation bezel 22. In this embodiment also, by operating the rotational position of the second rotation bezel 22, the rotation of the first rotation bezel 21 can be selectively restricted in one direction, and in both directions, and can be allowed in both directions. This embodiment can be modified such that the first rotation bezel 21 is located on the inner periphery of the second rotation bezel and the plate spring 10 is attached to the outer periphery of the second rotation bezel 21, resulting in the same advantage as described above.

This invention is not limited to the above embodiments, but can be variously modified. For example, a knob or a lever member may be provided in place of the second rotation bezel 22, as a member for releasing the rotational restriction of the first rotation bezel 21 by the plate spring. Moreover, another mechanism such as a ratchet may be used, in place of the plate spring, as a member for restricting the rotation of the rotation bezel. The positions of the rotation restricting member and the releasing member can be altered. Further, the present invention can be applied to apparatuses other than wrist watches, for example, a compass having a bezel which is positioned around a magnet and on which numerals representing direction angles are printed, or a tripod apparatus on which a telescope is mounted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus case with a rotation member, comprising:

a case body;

a rotation restricting member including a fixed portion fixed to the case body, and a resilient hook piece projecting upward from the fixed portion and being inclined with reference to the fixed portion;

a rotation member arranged above the rotation restricting member and having a rugged portion on a lower surface thereof, the rugged portion being engageable with a projecting end of the resilient hook piece of the rotation restricting member, and the rotation member being rotatable only in one direction when the projecting end of the resilient hook piece is engaged with the rugged portion of the rotation member; and a restriction release member rotatably arranged between the rotation member and the rotation restricting member and having an opening through which the projecting end of the resilient hook piece passes from the fixed portion toward the rugged portion of the lower surface of the rotation member, whereby when the restriction release member is rotated, the resilient hook piece of the rotation restricting member in the opening is pushed down to release the engagement of the projecting end of the resilient hook piece with the rugged portion of the lower surface of the rotation member, so that the rotation member is rotatable in both said one direction and another direction when said engagement of the projecting end of the resilient hook piece with the rugged portion is released.

2. An apparatus case with a rotation member according to claim 1, wherein said rotation member has a ring-shape.

3. An apparatus case with a rotation member according to claim 1, wherein the rugged portion of said rotation member is shaped like saw teeth.

4. An apparatus case with a rotation member according to claim 1, wherein said rotation restricting member has a ring-shape.

5. An apparatus case with a rotation member according to claim 1, wherein said rotation member has a ring-shape, and wherein an indication panel is disposed on an inner peripheral portion of a main surface of said rotation member.

* * * * *